US007492097B2

(12) United States Patent
Nakamura et al.

(10) Patent No.: US 7,492,097 B2
(45) **Date of Patent: *Feb. 17, 2009**

(54) ELECTRON MULTIPLIER UNIT INCLUDING FIRST AND SECOND SUPPORT MEMBERS AND PHOTOMULTIPLIER INCLUDING THE SAME

(75) Inventors: Kimitsugu Nakamura, Hamamatsu (JP); Yousuke Oohashi, Hamamatsu (JP); Keiichi Ohishi, Hamamatsu (JP); Masuo Ito, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 578 days.

This patent is subject to a terminal disclaimer.

(21) Appl. No.: 11/080,665

(22) Filed: Mar. 16, 2005

(65) Prior Publication Data

US 2006/0164007 A1 Jul. 27, 2006

Related U.S. Application Data

(60) Provisional application No. 60/646,506, filed on Jan. 25, 2005.

(51) Int. Cl.
*H01J 43/04* (2006.01)

(52) U.S. Cl. ..... 313/533; 313/532

(58) Field of Classification Search ..... None
See application file for complete search history.

(56) References Cited

U.S. PATENT DOCUMENTS 5,189,338 A * 2/1993 Ohishi et al. ..... 315/11
5,914,561 A 6/1999 Venkatarao et al.
2003/0132370 A1 * 7/2003 Kimura et al. ..... 250/214 VT

FOREIGN PATENT DOCUMENTS

| | | | |
|---|---|---|---|
| EP | 0 495 589 | A2 | 7/1992 |
| EP | 0 713 243 | A1 | 5/1996 |
| EP | 1 211 713 | A2 | 6/2002 |
| EP | 1 313 133 | A1 | 5/2003 |
| EP | 1 318 540 | A1 | 6/2003 |
| EP | 1 329 939 | A1 | 7/2003 |
| JP | 04-315758 | | 11/1992 |
| JP | 07-245078 | | 9/1995 |
| WO | 98/33202 | | 7/1998 |

* cited by examiner

*Primary Examiner*—Toan Ton
*Assistant Examiner*—Britt Hanley
(74) *Attorney, Agent, or Firm*—Drinker Biddle & Reath LLP

(57) ABSTRACT

This invention relates to an electron multiplier unit and others enabling cascade multiplication of electrons through successive emission of secondary electrons in multiple stages in response to incidence of primary electrons. The electron multiplier unit has a first support member provided with an inlet aperture for letting primary electrons in, and a second support member located so as to face the first support member. These first and second support members hold an electron multiplication section for the cascade multiplication and an anode. The electron multiplication section is comprised of at least a first dynode of a box type and a second dynode having a reflection type secondary electron emission surface located so as to face the first dynode and arranged to receive secondary electrons from the first dynode and to emit secondary electrons to a side where the first dynode is located. The anode is located at a position where the secondary electrons emitted from the first dynode do not directly arrive, and the second dynode alters a travel path of secondary electrons so as to be kept in a space between the first and second support members.

22 Claims, 14 Drawing Sheets

| | ELECTION TRAVEL DISTANCE (mm) | | |
|---|---|---|---|
| | CATHODE-DY1 | DY1-ANODE | CATHODE-ANODE |
| TRAJECTORY A | 44.2 | 92.1 | 136.3 |
| TRAJECTORY B | 45.0 | 88.3 | 133.3 |
| TRAJECTORY C | 46.0 | 94.9 | 140.9 |

ELECTRON MULTIPLIER UNIT INCLUDING FIRST AND SECOND SUPPORT MEMBERS AND PHOTOMULTIPLIER INCLUDING THE SAME

CROSS-REFERENCE TO RELATED APPLICATION

This application claims the benefit of the provisional application No. 60/646,506 filed on Jan. 25, 2005 by the same Applicant, the entire disclosure of which is herein incorporated by reference.

BACKGROUND OF THE INVENTION

1. Field of the Invention

The present invention relates to an electron multiplier unit enabling cascade multiplication of electrons through successive emission of secondary electrons in multiple steps in response to incidence of primary electrons, and to a photomultiplier including the same.

2. Related Background Art

The following conventional technologies are known as techniques prior to the electron multiplier unit and the photomultiplier including it according to the present invention.

Japanese Patent Application Laid-Open No. 7-245078

Japanese Patent Application Laid-Open No. 4-315758

WO98/33202

U.S. Pat. No. 5,914,561

SUMMARY OF THE INVENTION

The Inventor studied the above-cited conventional technologies and found the following problem.

Namely, the photomultipliers have been applied heretofore as photosensors in a variety of technical fields. Particularly, in application to detection of X-rays and radiated rays, it is necessary to shield the detector part including the photomultipliers, by a heavy metal such as Pb, and the total weight of apparatus depends on the weight of the heavy metal shield.

For example, a γ-camera device used as a medical inspection system is provided with at least a pair of upper and lower camera heads, and each camera head has a structure in which a plurality of photomultipliers are entirely covered by the Pb shield except for a detection window for exposing face plates of the photomultipliers arrayed in a two-dimensional pattern. The number of photomultipliers used has to increase for improvement in detection resolution, and, naturally, the increase of weight of the detector part including the heavy metal shield will pose an impediment to reduction of weight and size of apparatus.

Then the aforementioned Documents introduce the structure for decreasing the axial length (cylinder length) of the photomultipliers used, in order to reduce the gross weight of the heavy metal shield without degradation of detection resolution.

However, a new structure for further reduction of the cylinder length has been needed in order to satisfy the demand for improvement in detection resolution and the demand for reduction of total weight and size of apparatus together.

The present invention has been accomplished in order to solve the problem as discussed above, and an object of the invention is to provide an electron multiplier unit in a structure for enabling further reduction of the cylinder length, while achieving a high gain and maintaining or further improving the excellent fast response, and a photomultiplier including it.

An electron multiplier unit according to the present invention is an electronic component for effecting cascade multiplication of secondary electrons emitted in response to incidence of primary electrons, and is applicable to cascade multiplication structure of electron tubes, cascade multiplication structure of photomultipliers with a cathode for emitting photoelectrons as primary electrons upon acceptance of weak light of a predetermined wavelength, as well as X-rays and radiated rays, and so on.

An electron multiplier unit according to the present invention comprises a first support member provided with an inlet aperture for letting primary electrons in; a second support member located so as to face the first support member; and a first dynode, a second dynode, and an anode disposed in a space between the first and second support members. The first dynode is a dynode for receiving the primary electrons having passed through the inlet aperture of the first support member and for emitting secondary electrons, and has a reflection type secondary electron emission surface located so as to emit the secondary electrons into the space between these first and second support members, in a state in which it covers the inlet aperture of the first support member. The anode for capturing secondary electrons emitted into the space is located in the space between the first and second support members. However, this anode is disposed at a position where the secondary electrons emitted from the first dynode do not directly arrive. This is for the purpose of securing a sufficient installation area for the cascade multiplication structure of the secondary electrons on a secondary-electron travel path from the first dynode to the anode.

In particular, in the electron multiplier unit according to the present invention, the second dynode is a dynode provided for cascade multiplication of secondary electrons in the space between the first and second support members, and also functions as an electrode for changing the travel path of the secondary electrons. Namely, the second dynode has a reflection type secondary electron emission surface located so as to face the first dynode and arranged to emit new secondary electrons to the side where the first dynode is located, in response to the secondary electrons coming from the first dynode. This second dynode alters the travel path of the secondary electrons traveling from the first dynode toward the second dynode (secondary electrons traveling from the center of the unit to the outer periphery) so that it becomes parallel to the first and second support members. In other words, in the electron multiplier unit, the travel path of secondary electrons from the cathode toward the anode is corrected from the path along the radial direction from the center axis, into a path rotating around the center axis.

In the electron multiplier unit according to the present invention, a total length TL of the travel path of secondary electrons, i.e., an electron travel distance from the first dynode to the anode can be kept not less than two times, preferably four times, a distance D between the first support member and the second support member (a width of the space where the dynodes and others are located). By setting the cascade multiplication structure for obtaining an adequate gain, in the width D in this manner, it becomes feasible to further decrease the cylinder length of a photomultiplier tube to which the electron multiplier unit is applied.

The first support member preferably comprises a focusing electrode which surrounds at least a portion of the inlet aperture. This focusing electrode functions to alter trajectories of the photoelectrons, in order to guide the primary electrons (photoelectrons from the cathode in the case of a photomultiplier) to the inlet aperture provided in the first support member. The focusing electrode is a metal plate of trapezoidal shape cut in a tapered form at both ends, and is fixed to the first support member so that the lower base thereof extends along the outer periphery of the first support member.

The first support member may comprise an electrode piece one end of which is fixed to an edge part of the inlet aperture. This electrode piece extends so that the other end is located in a secondary-electron travel space between the first dynode and the second dynode (in the space between the first and second support members), in an assembled state of the electron multiplier unit, and the electrode piece functions as a control electrode (decelerating electrode) for directing the trajectories of the secondary electrons emitted from the first dynode, toward the second dynode.

In the electron multiplier unit according to the present invention, the inlet aperture provided in the first support member is preferably located so that a center of the inlet aperture deviates from a center of the first support member. In a photomultiplier to which the electron multiplier unit is applied, the center of the inlet aperture is located so as to deviate from a tube axis AX. This is for the purpose of efficiently housing the cascade multiplication structure, without increase in the diameter of the first support member or the tube cylinder.

Furthermore, the structure for cascade multiplication in the electron multiplier unit can be constructed of only box type dynodes, or of a combination of various types of dynodes. For example, the cascade multiplication structure from the second dynode to the anode, or the cascade multiplication structure from a third dynode to the anode may be replaced by grid type or mesh type dynodes. Normally, in the case of the mesh type dynodes, electrons pass through the mesh ($\eta$=40%), and it is thus necessary to use ten or more stages of dynodes in order to achieve an adequate gain. In contrast, the electron multiplier unit of the present invention involves preliminary multiplication of the secondary electrons emitted from the first dynode, by means of the second dynode or by means of the second and third dynodes, and thus it can achieve an adequate gain even by a dynode unit having a smaller number of stages.

A photomultiplier to which the electron multiplier unit having the structure as described above is applied (a photomultiplier according to the present invention) comprises a sealed envelope an interior of which is maintained in vacuum; a cathode provided in the sealed envelope; and the electron multiplier unit housed in the sealed envelope. The cathode releases photoelectrons as primary electrons into the sealed envelope, in response to incidence of light of a predetermined wavelength. The electron multiplier unit has the structure as described above and effects cascade multiplication of electrons by successively emitting secondary electrons in multiple steps in response to incidence of the photoelectrons released from the cathode.

In the photomultiplier having the structure as described above, the electron multiplier unit is one wherein an electron travel distance from the first dynode to the anode is kept not less than 1.5 times an electron travel distance from the cathode to the first dynode. An electron travel distance from the cathode to the anode is kept not less than 2 times the electron travel distance from the cathode to the first dynode.

Each of embodiments of the present invention will become further fully understandable in view of the detailed description given below and the accompanying drawings. It should be noted that these embodiments will be presented merely for illustrative purposes, and are not to be considered as limiting the present invention.

Further scope of application of the present invention will become apparent from the detailed description given below. It is, however, noted that the detailed description and specific examples, while indicating preferred embodiments of the present invention, are presented for illustrative purposes only, and it is apparent that various modifications and improvements within the spirit and scope of the invention will be obvious to those skilled in the art in view of the detailed description.

DETAILED DESCRIPTION OF THE PREFERRED EMBODIMENTS

Each of embodiments of the electron multiplier unit and the photomultiplier including it according to the present invention will be described below in detail with reference to FIGS. 1A, 1B, 2, 3A, 3B, 4-5, 6A-8B, 9, 10A-11B, 12, and 13A-14C. Identical portions and identical elements will be denoted by the same reference symbols in the description of the drawings, without redundant description.

Figure 1A:
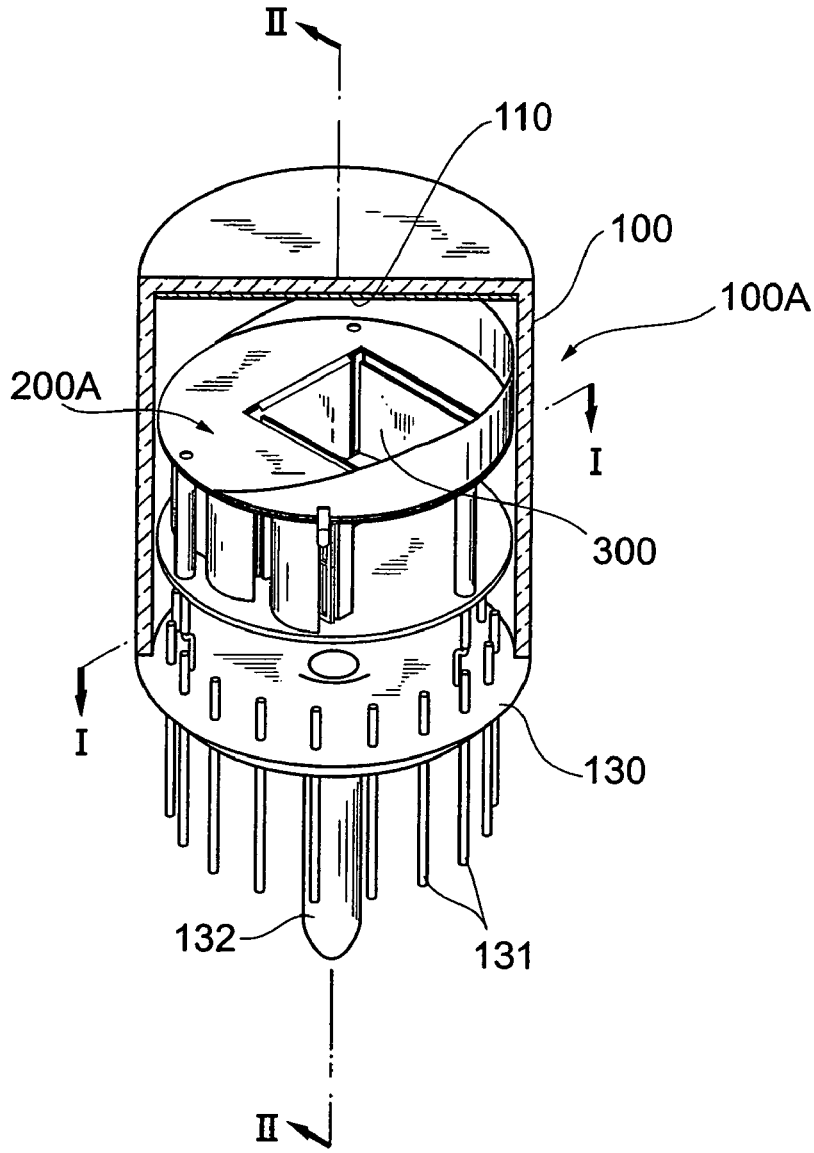
FIG. 1A is a partly broken view showing a schematic structure of a first embodiment of the photomultiplier according to the present invention.
Figure 1B:
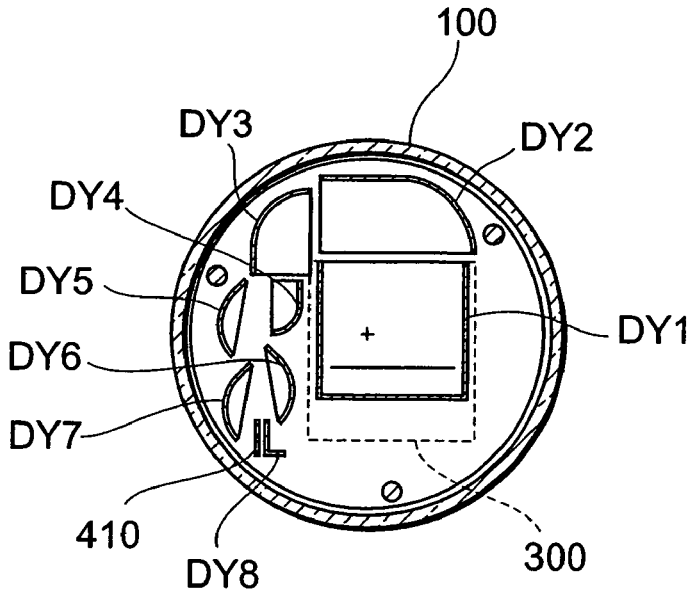
FIG. 1B is an illustration showing a sectional structure of the photomultiplier along line I-I in FIG. 1A.

FIG. 1A is a partly broken view showing a schematic structure of the first embodiment of the photomultiplier according to the present invention. FIG. 1B is an illustration showing a sectional structure of the photomultiplier according to the first embodiment along line I-I in FIG. 1A.

The photomultiplier 100A of the first embodiment has a sealed envelope or vessel the bottom part of which is provided with a pipe 132 (unhollowed after evacuation) for evacuating the interior, and has a cathode 110 and an electron multiplier unit 200A (a first embodiment of the electron multiplier unit according to the present invention) enclosed in the sealed envelope.

The sealed envelope is composed of a tube cylinder 100 of cylindrical shape having a face plate with the cathode 110 formed inside, and a stem 130 supporting a plurality of lead pins 131 in a penetrating state. The electron multiplier unit 200A is held at a predetermined position in the sealed envelope by the lead pins 131 extending from the stem 130 inside the sealed envelope.

The electron multiplier unit 200A, as shown in FIG. 1B, is composed of a first dynode DY1 for receiving photoelectrons having been released from the cathode 110 and having passed through an inlet aperture 300 and for emitting secondary electrons; second to seventh dynodes DY2-DY7 prepared for successive cascade multiplication of the secondary electrons emitted from the first dynode DY1; a mesh type anode 410; and a reflection type dynode DY8 for guiding trajectories of secondary electrons having passed through the anode 410, again to the anode 410. Particularly, the electron multiplier unit and the photomultiplier including it according to the present invention achieve further reduction of the cylinder length by adopting special arrangement of the second dynode. Namely, the second dynode DY2 is an electrode having a reflection type secondary electron emission surface located so as to face the first dynode DY1, and this reflection type secondary electron emission surface receives the secondary electrons from the first dynode DY1, is located so as to emit secondary electrons toward the third dynode DY3 located adjacent to the first dynode DY1, and functions as a path changing electrode for changing the travel path of the secondary electrons into a direction different from the axial direction of the sealed envelope.

Figure 2:
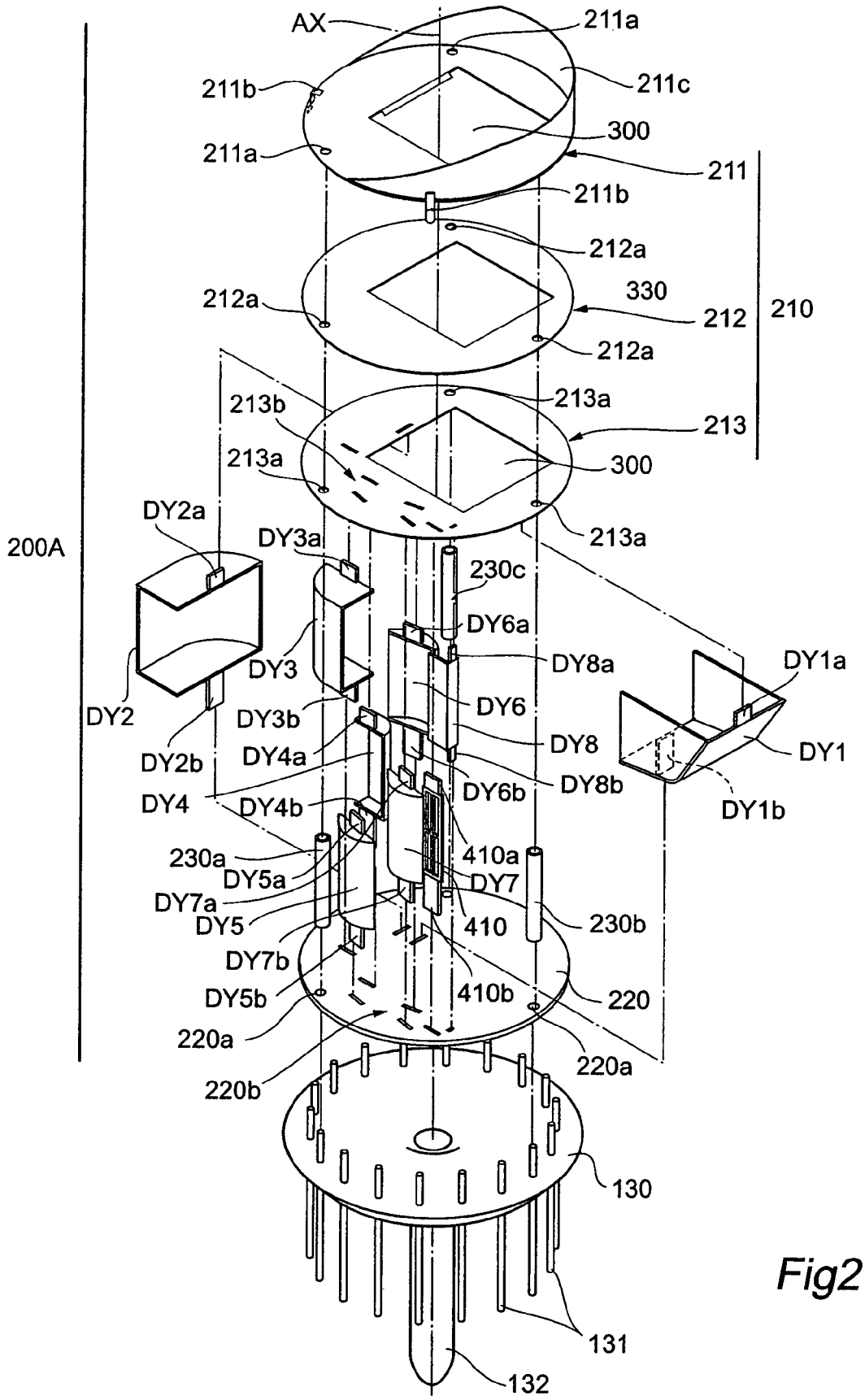
FIG. 2 is an assembling process chart for explaining the structure of the electron multiplier unit shown in FIG. 1A.

FIG. 2 is an assembling process chart for explaining the structure of the electron multiplier unit 200A shown in FIG. 1A (the first embodiment of the electron multiplier unit according to the present invention).

As shown in FIG. 2, the electron multiplier unit 200A is comprised of a first support member 210 provided with an inlet aperture 300 for letting the photoelectrons from the cathode 110 pass; a second support member 220 arranged in parallel with the first support member 210 along the tube axis AX; first to seventh dynodes DY1-DY7, an anode 410, and a reflection type dynode DY8 placed in the space between these first and second support members 210, 220 and each held by the first and second support members 210, 220. The distance between the first and second support members 210, 220 is defined by hollow ceramic pipes 230*a* to 230*c*. The first dynode DY1 is provided with an upper fixing piece DY1*a* and a lower fixing piece DY1*b* so as to be held by the first and second support members 210, 220. Similarly, the second dynode DY2 has an upper fixing piece DY2*a* and a lower fixing piece DY2*b*; the third dynode DY3 an upper fixing piece DY3*a* and a lower fixing piece DY3*b*; the fourth dynode DY4 an upper fixing piece DY4*a* and a lower fixing piece DY4*b*; the fifth dynode DY5 an upper fixing piece DY5*a* and a lower fixing piece DY5*b*; the sixth dynode DY6 an upper fixing piece DY6*a* and a lower fixing piece DY6*b*; the seventh dynode DY7 an upper fixing piece DY7*a* and a lower fixing piece DY7*b*; the anode 410 an upper fixing piece 410*a* and a lower fixing piece 410*b*; the reflection type dynode DY8 an upper fixing piece DY8*a* and a lower fixing piece DY8*b*.

The first support member 210 has a three-layer structure composed of a metal disk 211 set at a predetermined potential, and ceramic disks 212, 213 each made of an insulating material.

The metal disk 211 has holes 211*a*, spring pieces 211*b*, and a focusing electrode 211*c*, in addition to the inlet aperture 300. The lead pins 131 are connected to the metal disk 211 in a state in which the tip thereof penetrates through the holes 211*a*. The spring pieces 211*b* are brought into contact with the inner wall of the tube cylinder 100 in order to stabilize the position of the whole of the electron multiplier unit 200A relative to the tube cylinder 100, particularly, the vertical position relative to the tube axis AX. The focusing electrode 211*c* functions to alter the trajectories of the photoelectrons, in order to guide the photoelectrons from the cathode 110 to the inlet aperture 300 provided in the first support member 210.

Each of ceramic disks 212, 213 is also provided with holes 212*a* or 213*a* for letting the lead pins 131 pass, in addition to the inlet aperture 300, and the ceramic disk 213 is further provided with engaging holes 213*b* for keeping the upper fixing pieces DY1*a*-DY7*a*, 410*a*, and DY8*a* of the respective members placed between the first and second support members 210, 220, between the ceramic disks 212, 213.

The second support member 220 is a ceramic disk made of an insulating material, and is provided with holes 220*a* for letting the lead pins 131 pass, and engaging holes 220*b* for accepting the lower fixing pieces DY1*b*-DY7*b*, 410*b*, and DY8*b* of the respective members placed between the first and second support members 210, 220. These lower fixing pieces DY1*b*-DY7*b*, 410*b*, and DY8*b* are electrically connected to the lead pins 131 each extending from the stem 130, whereby each of the members DY1-DY7, 410, and DY8 located between the first and second support members 210, 220 is set at a predetermined potential.

Some of the lead pins 131 extending from the stem 130 are electrically connected to the metal disk 211 via the holes 211*a* of the metal disk 211 in a state in which each passes through the hole 220*a* of the second support member 220, the ceramic pipe 230*a*-230*c*, and the holes 212*a*, 213*a* of the ceramic disks 212, 213.

Figure 3A:
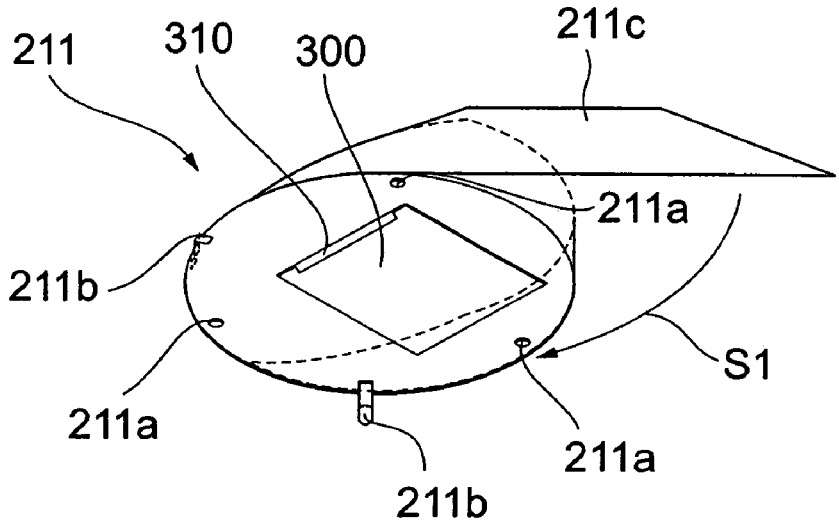
FIG. 3A is a perspective view showing a structure of a metal disk forming a part of the electron multiplier unit.
Figure 3B:
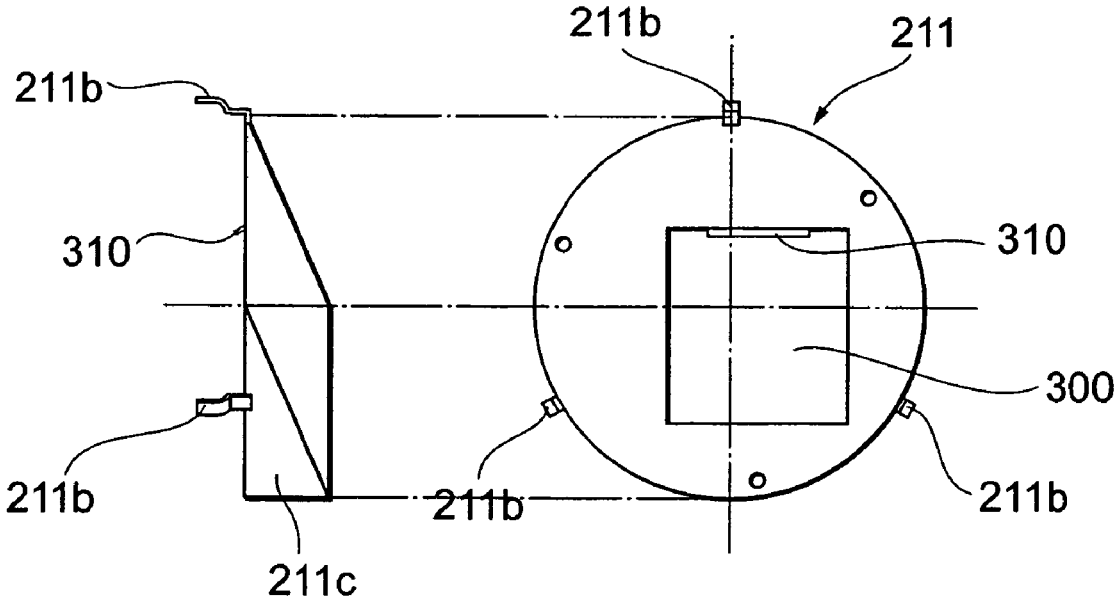
FIG. 3B is a plan view and side view showing the structure of the metal disk.

FIG. 3A is a perspective view showing the structure of the metal disk 211 forming a part of the first support member 210. FIG. 3B is a plan view and side view showing the structure of the metal disk 211 shown in FIG. 3A.

As described above, the metal disk 211 has the holes 211*a* for electrically connecting the lead pins 131 extending from the stem 130, to the metal disk 211 in the state in which the pins penetrate the holes; the spring pieces 211*b* for stabilizing the installation position of the metal disk 211 itself; and the focusing electrode 211*c* for altering the trajectories of photoelectrons released from the cathode 110. Particularly, the focusing electrode 211*c* is a metal plate of trapezoidal shape cut in a tapered form at both ends, as shown in FIG. 3A, and is bent in the direction indicated by arrow S1 to be fixed to the outer periphery of the disk body.

The metal disk 211 further has an electrode piece 310 extending toward the interior of the inlet aperture 300. This electrode piece 310, in an assembled state of the electron multiplier unit 200A, has a part located in the secondary-electron travel space between the first dynode DY1 and the second dynode DY2, and functions as a control electrode (decelerating electrode) for directing the trajectories of secondary electrons emitted from the first dynode DY1, toward the second dynode DY2.

Figure 4:
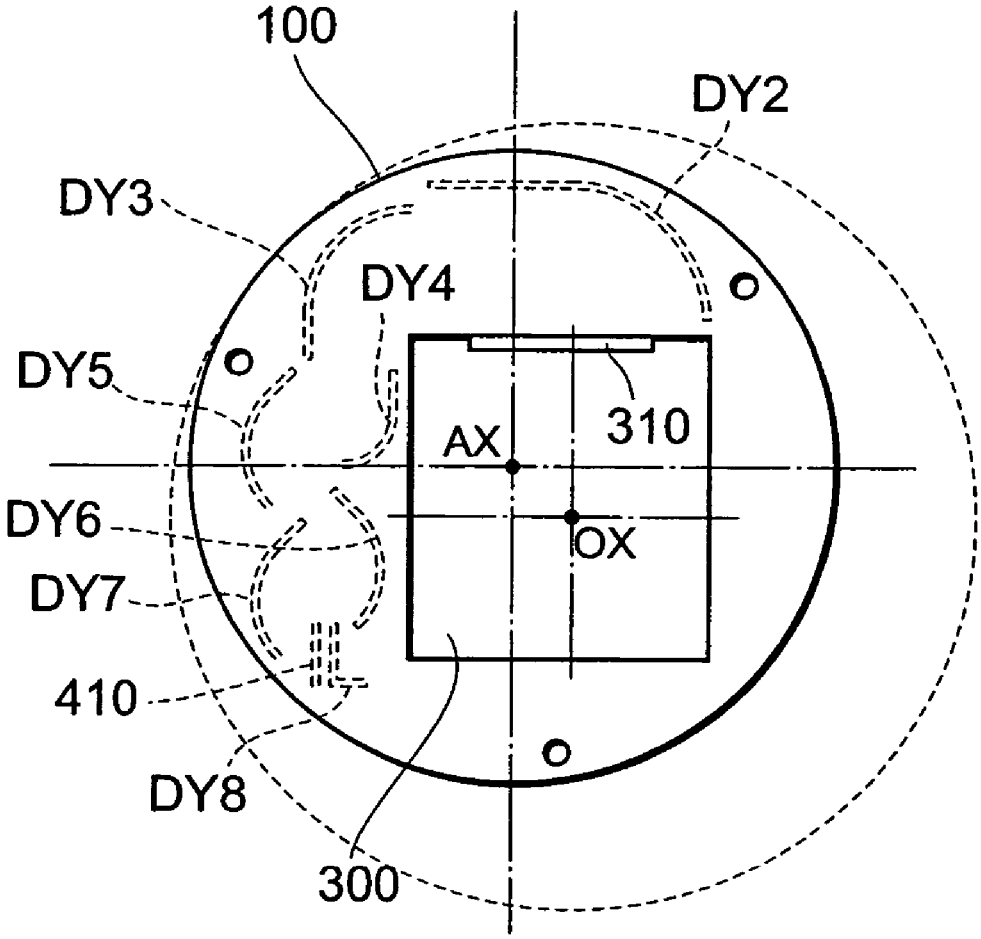
FIG. 4 is a top plan view of the electron multiplier unit, for explaining the position of an inlet aperture provided in a first support member forming a part of the electron multiplier unit.

FIG. 4 is a top plan view of the electron multiplier unit 200A, for explaining the position of the inlet aperture 300 in the first support member 210 forming a part of the electron multiplier unit 200A.

As also seen from this FIG. 4, the inlet aperture 300 provided in the first support member 210 is located so that the center Ox thereof deviates from the tube axis AX. The reason is that if the inlet aperture 300 is located at the center of the first support member 210 so as to achieve agreement between the center Ox and the tube axis AX, the diameter of the tube cylinder must be increased in order to secure a sufficient space for housing the members DY1-DY7, 410, and DY8 located between the first and second support members 210, 220.

Figure 5:
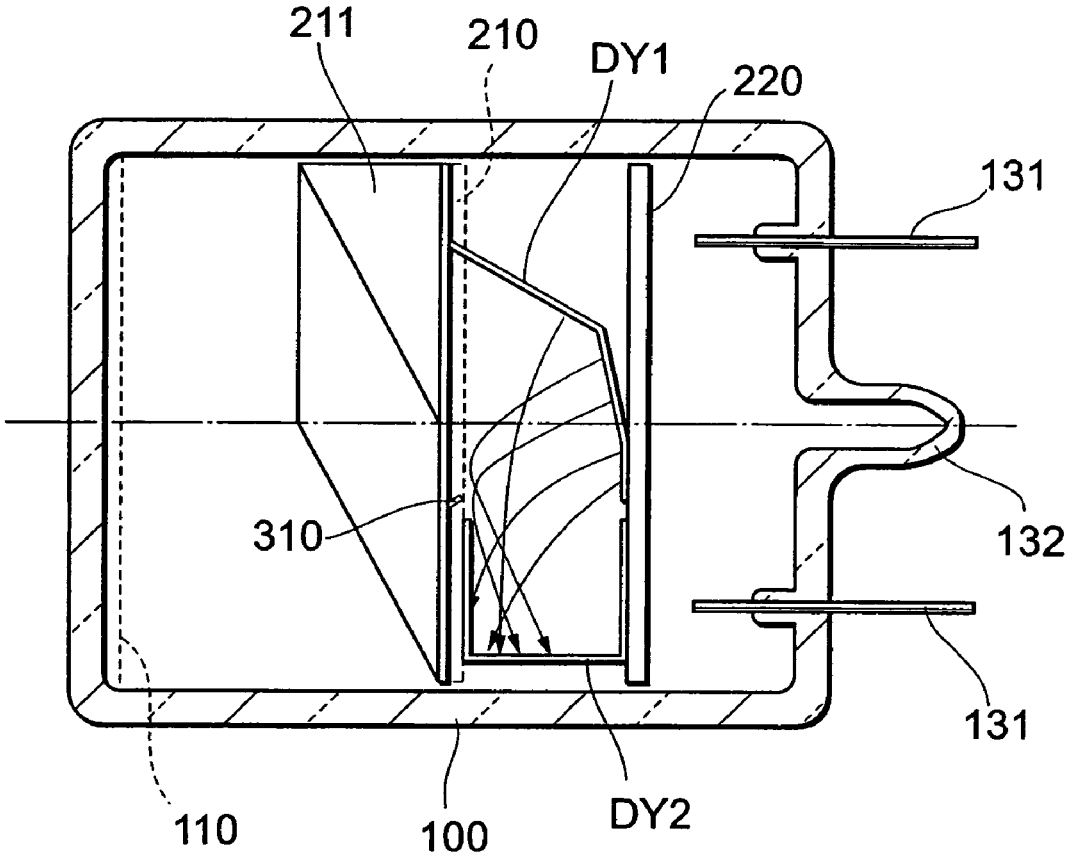
FIG. 5 is a sectional view of the photomultiplier according to the first embodiment, along line II-II in FIG. 1A.

FIG. 5 is a sectional view of the photomultiplier 100A according to the first embodiment, along line II-II in FIG. 1A, and illustration for explaining the function of the electrode 310 at the edge of the inlet aperture 300 in the first support member 210. As also seen from this FIG. 5, the electrode 310 is so arranged that a part thereof is located in the travel space of secondary electrons from the first dynode DY1 to the second dynode DY2, and is set at the same potential as the focusing electrode 211*c* of the metal disk 211 forming a part of the first support member 210. This electrode 310 decelerates the secondary electrons emitted from the first dynode DY1 toward the inlet aperture 300, and alters the trajectories thereof so as to be directed toward the second dynode DY2.

Figure 6A:
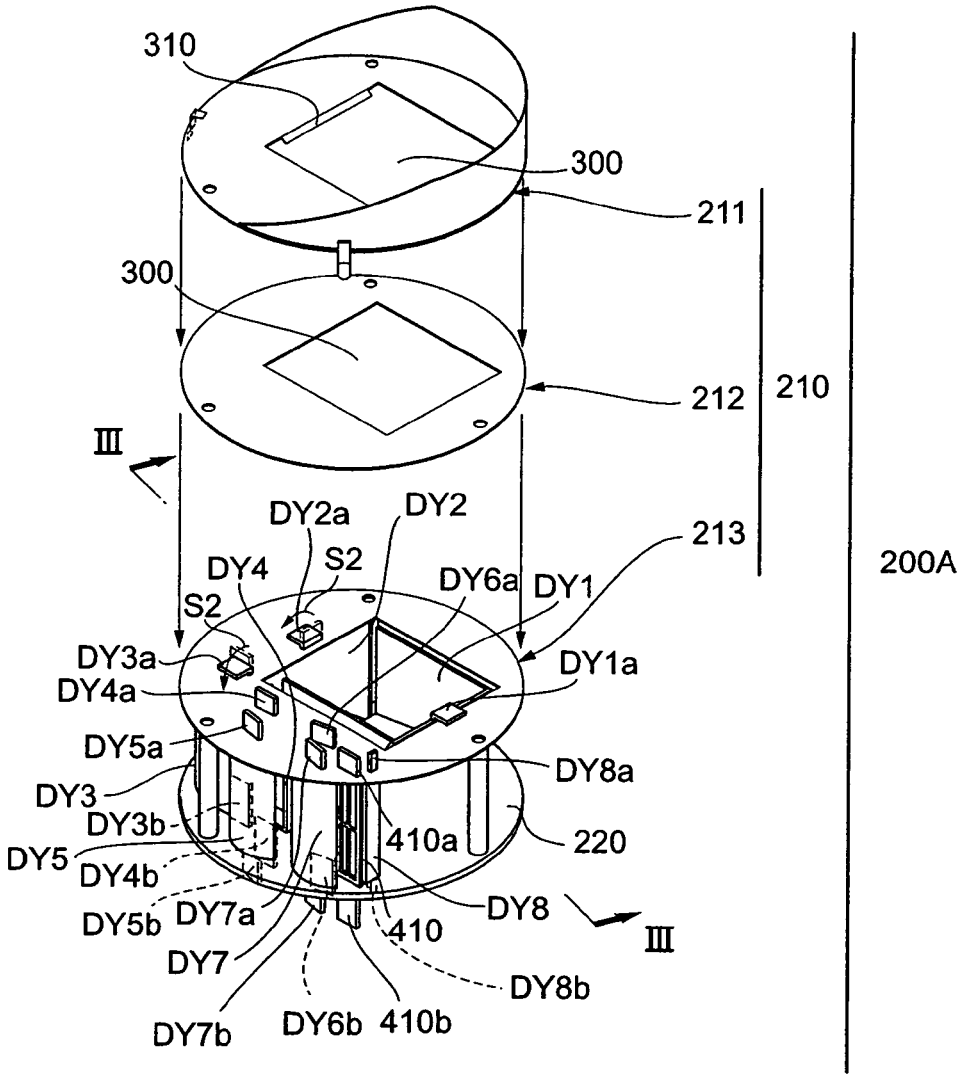
FIG. 6A is a perspective view for explaining a dynode mounting structure in the electron multiplier unit.
Figure 6B:
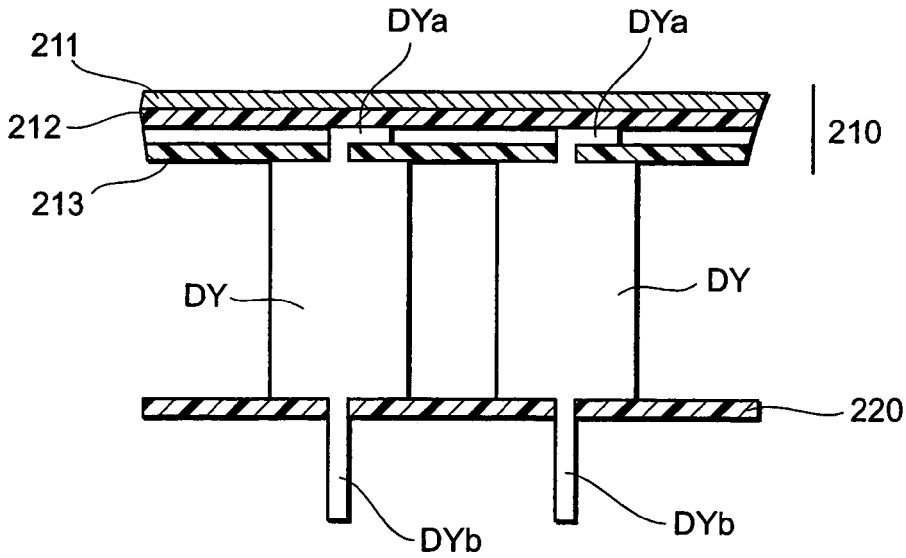
FIG. 6B is a sectional view of the electron multiplier unit along line III-III shown in FIG. 6A.

FIG. 6A is an illustration for explaining the dynode mounting structure in the electron multiplier unit 200A, and FIG. 6B is a sectional view of the electron multiplier unit 200A along line III-III in FIG. 6A.

As shown in this FIG. 6A, the upper fixing pieces DY1*a*-DY7*a* of the first to seventh dynodes DY1-DY7 each are bent in the direction indicated by arrows S2 and in a penetrating state through the holes 213*b* provided in the ceramic disk 213. The upper fixing piece 410*a* of the anode 410 and the upper fixing piece DY8*a* of the reflection type dynode DY8 are also bent in a penetrating state through the corresponding holes 213*b* in the ceramic disk 213. Thereafter, the ceramic disk 213 is bonded to the ceramic disk 212 to fix the upper parts of the respective members DY1-DY7, 410, and DY8 to the first support member 210 composed of the metal disk 211 and ceramic disks 212, 213. Namely, the upper parts of the members DY1-DY7, 410, and DY8 are fixed to the first support member 210 so that the bent portions of the upper fixing pieces DY1*b*-DY7*b*, 410*b*, and DY8*b* are sandwiched between the ceramic disks 212, 213, as shown in FIG. 6B.

On the other hand, the lower fixing pieces DY1*b*-DY7*b*, 410*b*, and DY8*b* of the first to seventh dynodes DY1-DY7, anode 410, and reflection type dynode DY8 each are electrically connected to the lead pins 131 extending from the stem 130, in a penetrating state through the holes 210*b* provided in the second support member 220. In this manner the electron multiplier unit 200A is supported by the lead pins 131 connected to the lower fixing pieces DY1*b*-DY7*b*, 410*b*, and DY8*b* of the members DY1-DY7, 410, and DY8 sandwiched between the first and second support members 210, 220.

Figure 7A:
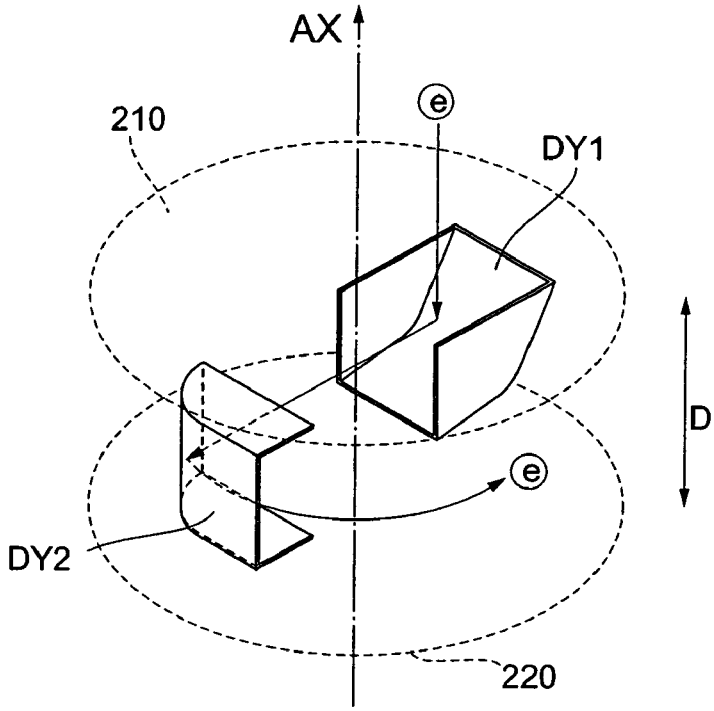
FIGS. 7A to 7C are illustrations for explaining a specific positional relation of dynodes in the electron multiplier unit.
Figure 7B:
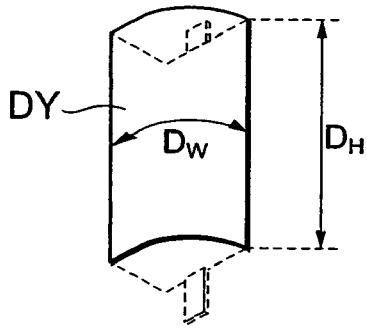
Figure 7C:
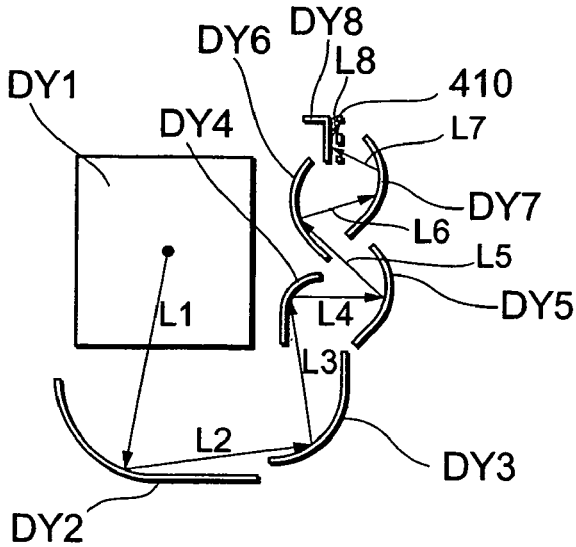

Next, a specific positional relation of the dynodes in the electron multiplier unit 200A will be described. FIGS. 7A to 7C are illustrations for explaining the specific positional relation of the dynodes and others by use of trajectories of secondary electrons multiplied in the electron multiplier unit 200A, and others.

Namely, the first to seventh dynodes DY1-DY7, anode 410, and reflection type dynode DY8 are placed in the space with the width D between the first and second support members 210, 220. The first dynode DY1 is held by the first and second support members 210, 220 in a state in which it covers the inlet aperture 300 of the first support member 210. The secondary electron emission surface of the first dynode DY1 is set to receive photoelectrons having passed through the inlet aperture 300 and to emit secondary electrons into the space between the first and second support members 210, 220. The anode 410 is located at a position where the secondary electrons emitted from this first dynode DY1 do not directly arrive. This is for the purpose of securing a sufficient installation area for the structure enabling the cascade multiplication of secondary electrons in the path from the first dynode DY1 to the anode 410. In the electron multiplier unit 200A, the second dynode DY2 performs correction for the main travel path of the secondary electrons, in order to achieve the cascade multiplication of secondary electrons in the space between the first and second support members 210, 220. Specifically, the second dynode DY2 is an electrode having a reflection type secondary electron emission surface arranged to face the first dynode DY1, and functions as a path changing electrode for receiving the secondary electrons from the first dynode DY1 and for changing the travel path of the secondary electrons into a direction different from the axial direction of the sealed envelope so as to emit the secondary electrons toward the third dynode DY3 arranged adjacent to the first dynode DY1. This second dynode DY2 alters the main travel path of secondary electrons from the first dynode DY1 to the second dynode DY2 (secondary electrons traveling in the radial direction from the tube axis AX), into the direction rotating around the tube axis AX (cf FIG. 7A).

The main travel path of secondary electrons means the shortest trajectory of secondary electrons from the first dynode DY1 to the anode 410, and is defined by connecting the center of the secondary electron emission surface in the first dynode DY1 to the center of the anode 410 via the centers of the secondary electron emission surfaces in the respective dynodes DY2-DY7 by a plurality of line segments.

Namely, since the dynodes applied to the electron multiplier unit 200A are box type dynodes DY, their secondary electron emission surface has the rectangular shape with the height DH and the width Dw, as shown in FIG. 7B. For this reason, the center of the secondary electron emission surface in the dynode DY (box type dynode) can be readily specified (by height $D_H/2$ and width $D_W/2$). Under these circumstances, the main travel path of secondary electrons is defined on a plane normal to the tube axis AX.

The total length TL of the main travel path of secondary electrons defined as described above is thus a total of a travel distance L1 from the first dynode DY1 to the second dynode DY2, a travel distance L2 from the second dynode DY2 to the third dynode DY3, a travel distance L3 from the third dynode DY3 to the fourth dynode DY4, a travel distance L4 from the fourth dynode DY4 to the fifth dynode DY5, a travel distance L5 from the fifth dynode DY5 to the sixth dynode DY6, a travel distance L6 from the sixth dynode DY6 to the seventh dynode DY7, a travel distance L7 from the seventh dynode DY7 to the eighth dynode (inversion type dynode) DY8, and a travel distance L8 from the inversion type dynode DY8 to the anode 410, as shown in FIG. 7C. Particularly, in this electron multiplier unit of the present invention, the total length TL of the main travel path of secondary electrons can be kept not less than 2, preferably 4, times the distance D between the first support member 210 and the second support member 220 (the width of the space where the dynodes and others are located).

Figures 8A, 8B:
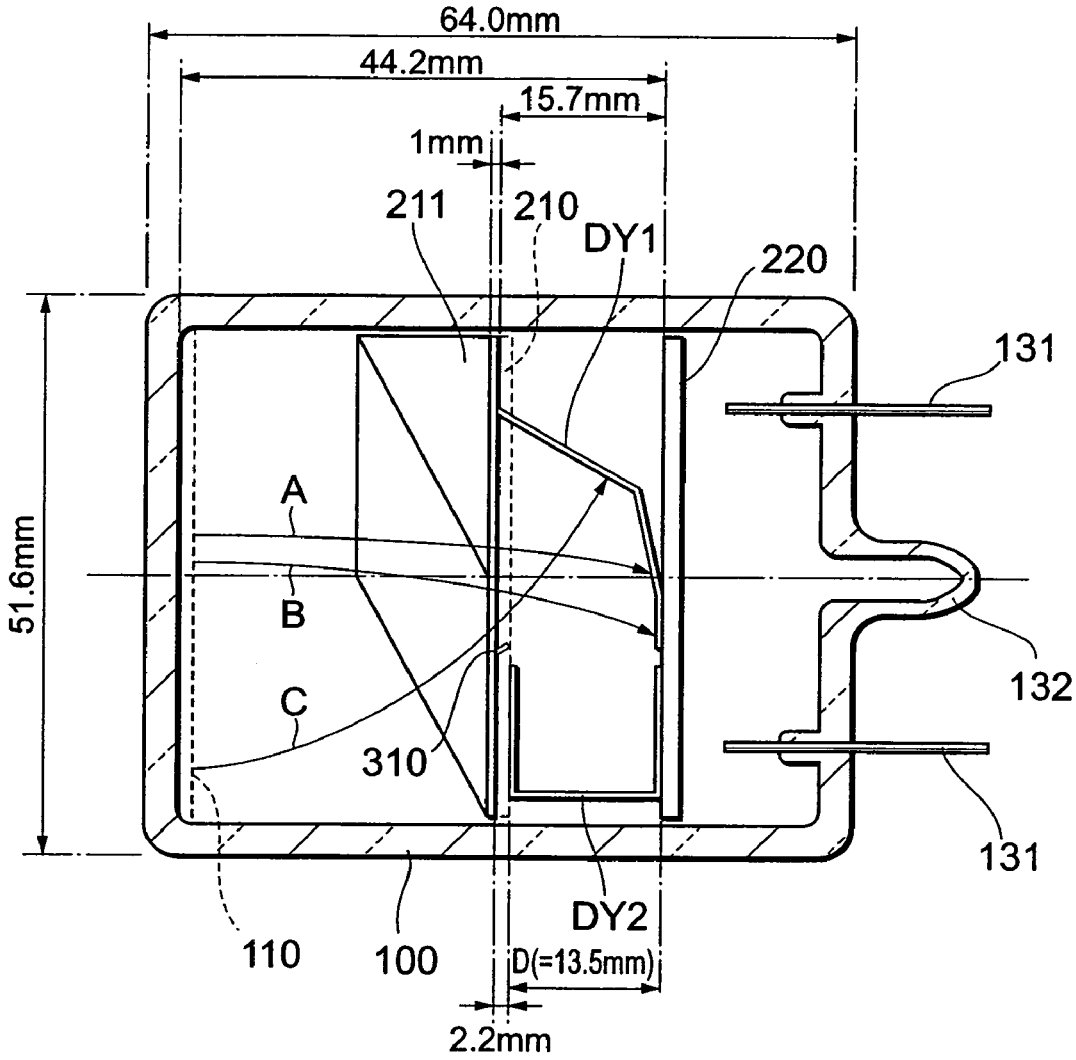
FIG. 8A is a sectional view showing the outer size of the photomultiplier tube prepared for calculation of electron travel distances.
FIG. 8B is a table showing electron travel distances between sections in the photomultiplier tube with the outer size shown in FIG. 8A.

Next, specific outer size ratios of the photomultiplier according to the present invention will be described. FIG. 8A is a sectional view showing the outer size of the photomultiplier prepared for calculation of electron travel distances, and FIG. 8B a table showing the electron travel distances between sections in the photomultiplier of the outer size shown in FIG. 8A.

The sample prepared as the photomultiplier according to the present invention is a photomultiplier with the sealed envelope 100 having the diameter of 51.6 mm and the cylinder length of 64.0 mm, as shown in FIG. 8A. In the electron multiplier unit housed in this sealed envelope 100, the width D between the first support member 210 and the second support member 220 is set at 13.5 mm, and eight stages of dynodes are arranged, as in the structure shown in FIG. 7C, in the space between the first and second support members 210, 220.

The Inventors calculated the electron travel distances as to several types of trajectories in the photomultiplier of this sample. Specifically, A in FIG. 8A indicates a standard electron trajectory, B the shortest trajectory, and C the longest trajectory. FIG. 8B shows a table including a list of electron travel distances in the electron travel path from the cathode to the first dynode DY1 (cathode-DY1), the electron travel path from the first dynode DY1 to the anode (DY1-anode), and the electron travel path from the cathode to the anode (cathode-anode), for these three types of trajectories.

As shown in the table of FIG. 8B, the standard electron trajectory A showed the electron travel distance of 44.2 mm in the path (cathode-DY1), the electron travel distance of 92.1 mm in the path (DY1-anode), and the electron travel distance of 136.3 mm in the path (cathode-anode). The shortest electron trajectory B demonstrated the electron travel distance of 45.0 mm in the path (cathode-DY1), the electron travel distance of 88.3 mm in the path (DY1-anode), and the electron travel distance of 133.3 mm in the path (cathode-anode). The longest electron trajectory C demonstrated the electron travel distance of 46.0 mm in the path (cathode-DY1), the electron travel distance of 94.9 mm in the path (DY1-anode), and the electron travel distance of 140.9 mm in the path (cathode-anode).

As seen from the above calculation result, in the photomultiplier of the present invention the electron travel distance from the first dynode DY1 to the anode 410 is kept not less than 6 times the distance D (=13.5 mm) between the first support member 210 and the second support member 220. In addition, the electron travel distance from the first dynode DY1 to the anode 410 is kept not less than 1.5 times the electron travel distance from the cathode 110 to the first dynode DY1. Furthermore, the electron travel distance from the cathode 110 to the anode 410 is kept not less than 2 times the electron travel distance from the cathode 110 to the first dynode DY1.

Figure 9:
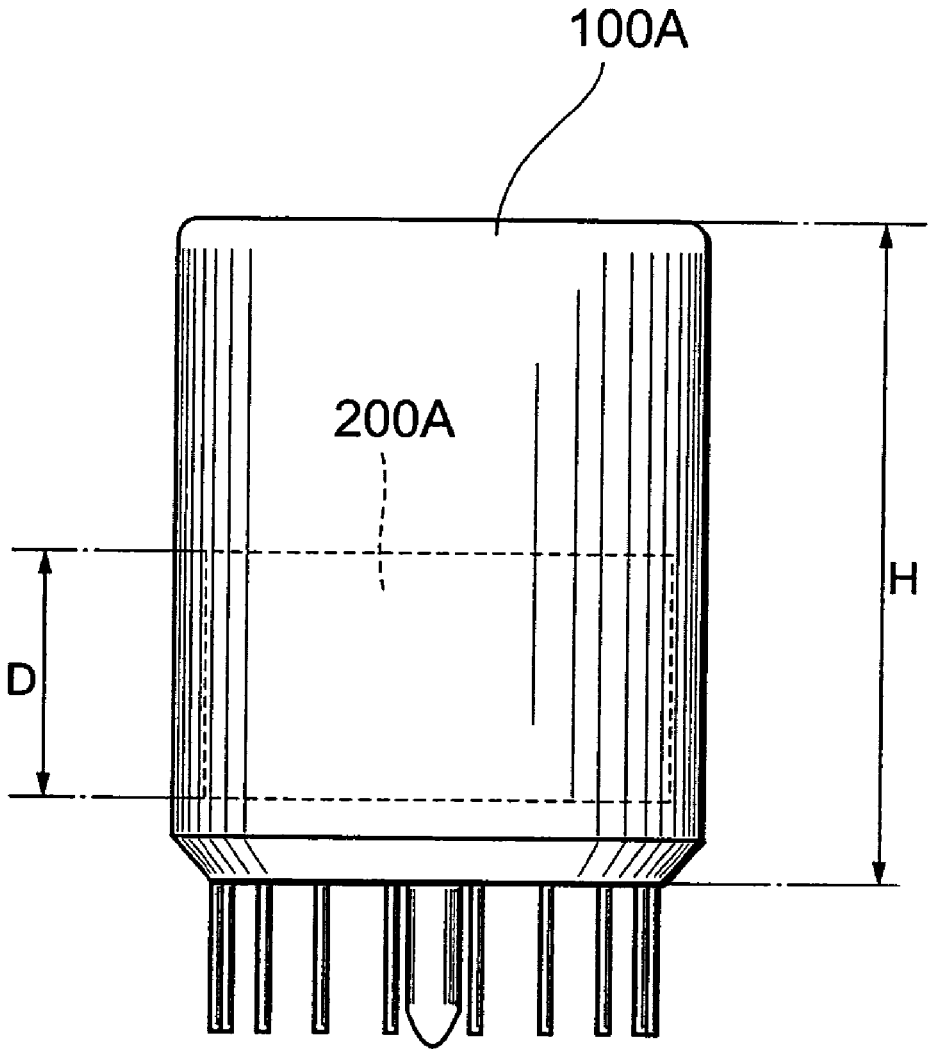
FIG. 9 is an illustration for comparing the sizes in the axial direction between the photomultiplier and the electron multiplier unit included therein.

As constructed in the above configuration, the photomultiplier 100A to which the electron multiplier unit 200A is applied has the structure capable of further reducing the tube length H, in comparison with those of the conventional photomultipliers (cf. FIG. 9). FIG. 9 is an illustration for comparing the axial sizes of the photomultiplier 100A of the first embodiment and the electron multiplier unit 200A included therein (the first embodiment).

Figure 10A:
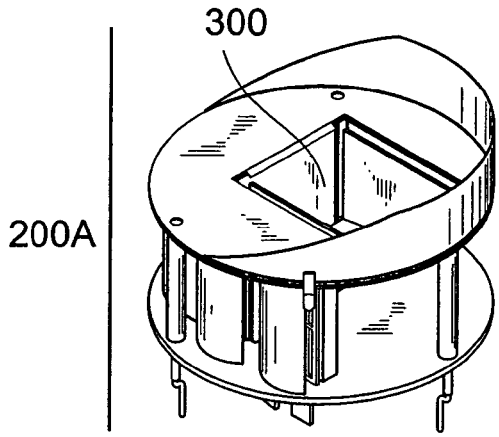
FIG. 10A is a perspective view showing a schematic structure of the electron multiplier unit (first embodiment) according to the present invention.

The photomultiplier 100A of the first embodiment described above has the structure in which the electron multiplier unit 200A (the first embodiment of the electron multiplier unit according to the present invention) is housed in the tube cylinder 100, but there are no particular restrictions on the shape of the vessel in which the electron multiplier unit 200A is housed. For example, FIG. 10A is a perspective view showing a schematic structure of the electron multiplier unit 200A according to the first embodiment, and FIG. 10B is a partly broken view showing a schematic structure of a second embodiment of the photomultiplier according to the present invention, to which the electron multiplier unit 200A shown in FIG. 10A is applied.

Figure 10B:
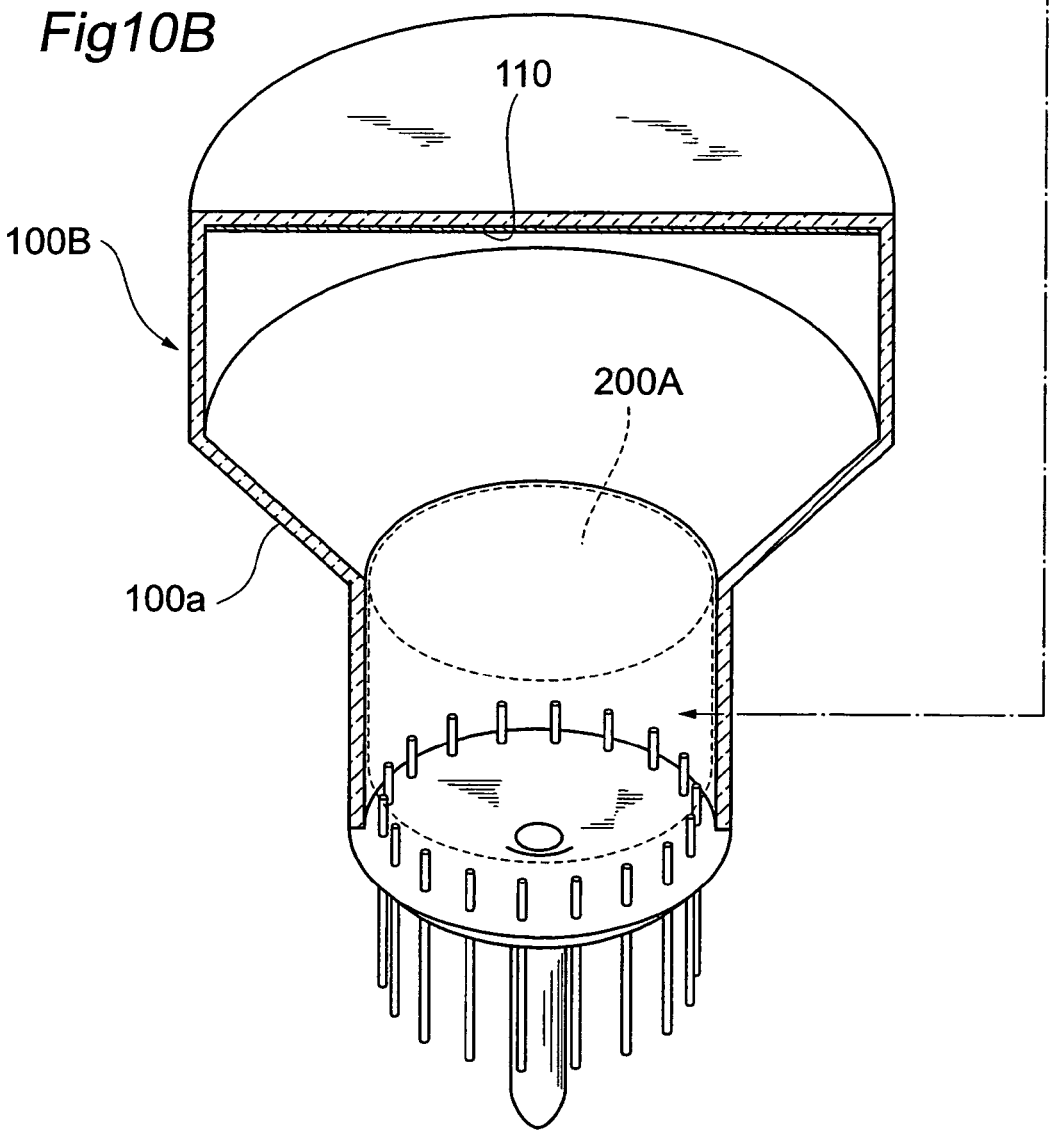
FIG. 10B is a partly broken view showing a schematic structure of a second embodiment of the photomultiplier according to the present invention, to which the electron multiplier unit shown in FIG. 10A is applied.

As shown in FIG. 10B, a tube cylinder 100*a* of a shape the area of the face plate of which with the cathode 110 inside is expanded may be applied as a part of the sealed envelope housing the electron multiplier unit 200A.

Furthermore, the structure for cascade multiplication in the electron multiplier unit can also be realized without use of only the box type dynodes as described above. Namely, the cascade multiplication structure from the second dynode DY2 to the anode 410, or the cascade multiplication structure from the third dynode DY3 subsequent to the second dynode DY2, to the anode 410 may be replaced by grid type dynodes or mesh type dynodes. Normally, in the case of the mesh type dynodes, electrons pass through the mesh ($\eta$=40%), and it is thus necessary to use ten or more stages of dynodes in order to achieve an adequate gain. However, since the present invention involves the preliminary multiplication of secondary electrons emitted from the first dynode DY1, by the second dynode DY2 or by the second and third dynodes DY2, DY3, it can achieve an adequate gain even by the dynode unit having a smaller number of stages.

Figure 11A:
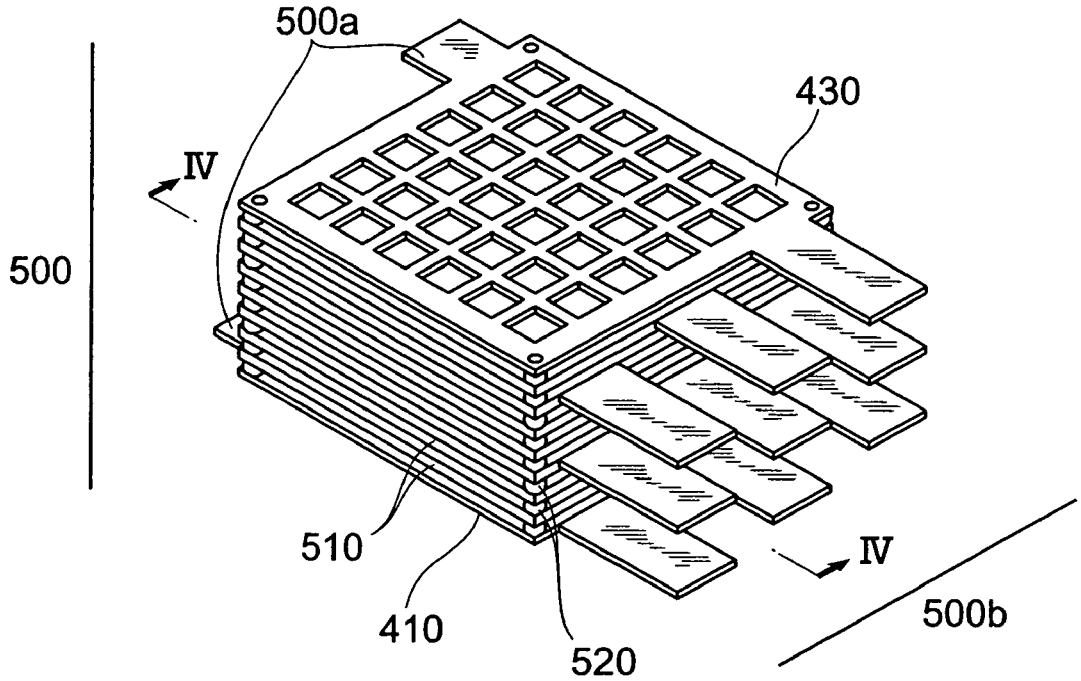
FIG. 11A is a perspective view showing a structure of a grid type dynode unit applicable as a part of the electron multiplier unit according to the present invention.
Figure 11B:
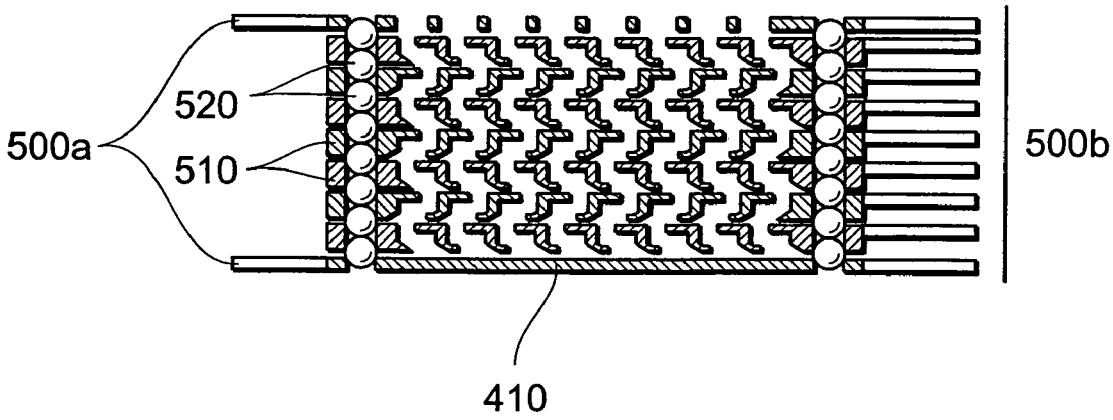
FIG. 11B is a sectional view of the grid type dynode unit along line IV-IV in FIG. 11A.

FIG. 11A is a perspective view showing a structure of a grid type dynode unit 500 applicable as a part of the electron multiplier unit according to the present invention (the second embodiment of the electron multiplier unit according to the present invention). FIG. 11B is a sectional view of the grid type dynode unit 500 along line IV-IV in FIG. 11A. The dynode unit 500 shown in FIGS. 11A and 11B has a multi-stage configuration of grid type dynodes, but may have a multi-stage configuration of mesh type dynodes.

As shown in FIGS. 11A and 11B, the grid type dynode unit 500 is composed of a focusing electrode plate 430, dynode plates 510 set at predetermined intervals by ceramic spacers 520 each made of an insulating material, and an anode plate 410.

Each of the focusing electrode plate 430 and the anode plate 410 is provided with an upper fixing piece 500*a*. Each of the focusing electrode plate 430, dynode plates 510, and anode plate is provided with a lower fixing piece 500*b* to be electrically connected to a lead pin 131 extending from the stem. Each dynode plate 510 is set at a predetermined potential through the lower fixing piece 500*b*.

Figure 12:
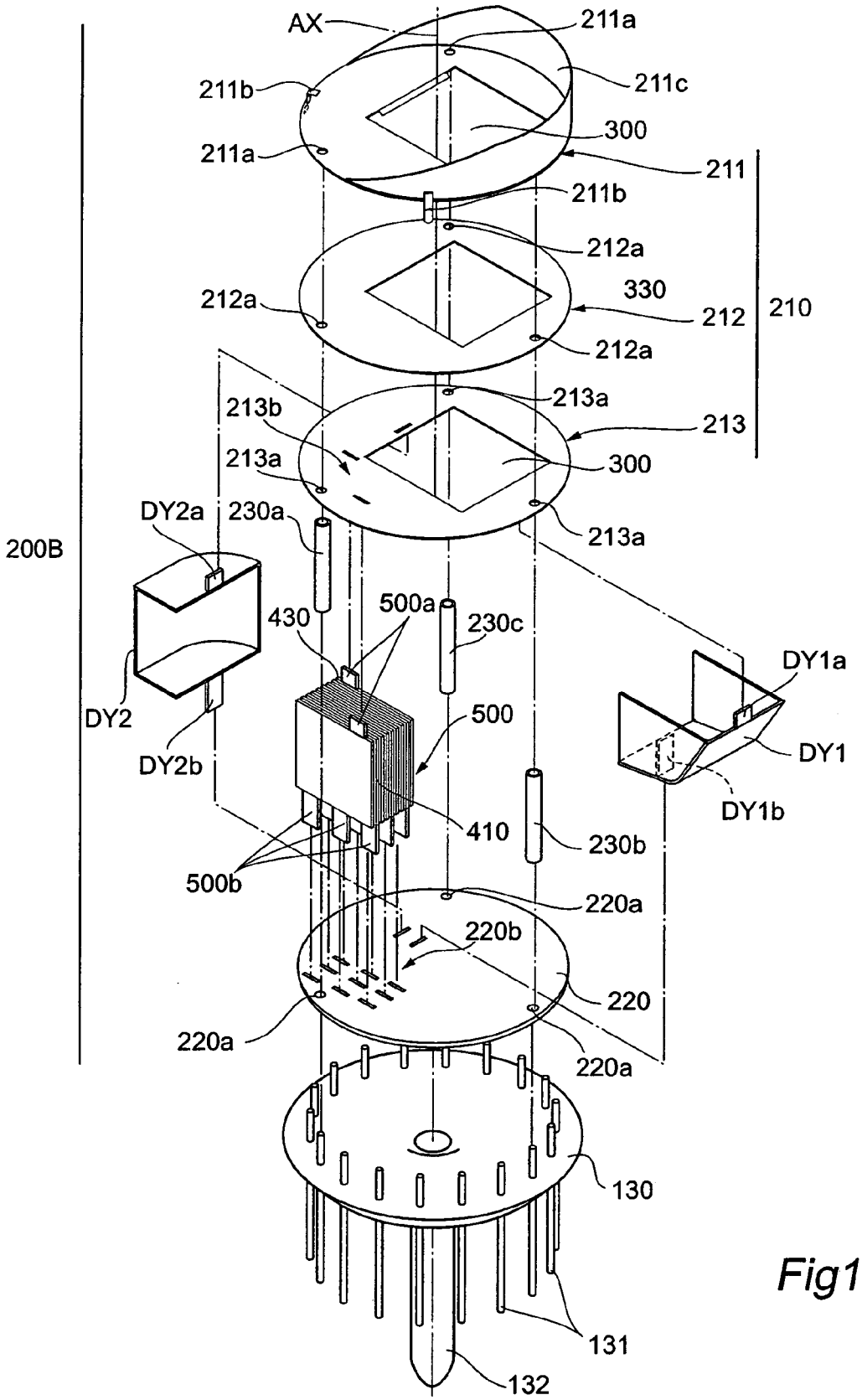
FIG. 12 is an assembling process chart for explaining the structure of the electron multiplier unit (second embodiment) to which the grid type dynode unit shown in FIG. 11A is applied.

FIG. 12 is an assembling process chart for explaining the structure of an electron multiplier unit 200B (second embodiment) to which the grid type dynode unit 500 shown in FIGS. 11A and 11B is applied.

As shown in FIG. 12, the electron multiplier unit 200B is composed of a first support member 210 provided with an inlet aperture 300 for letting photoelectrons from cathode 110 pass; a second support member 220 arranged in parallel with the first support member 210 along the tube axis AX; and a first dynode DY1, a second dynode DY2, and the dynode unit 500 shown in FIGS. 11A and 11B (including the anode 410), which are placed in the space between these first and second support members 210, 220 and each of which is supported by the first and second support members 210, 220. The distance between the first and second support members 210, 220 is defined by hollow ceramic pipes 230*a*-230*c*. The first dynode DY1 is provided with an upper fixing piece DY1*a* and a lower fixing piece DY1*b* so as to be held by the first and second support members 210, 220. Similarly, the second dynode DY2 has an upper fixing piece DY2*a* and a lower fixing piece DY2*b*, and the dynode unit 500 has the upper fixing pieces 500*a* and the lower fixing pieces 500*b*.

The first support member 210 has a three-layer structure composed of a metal disk 211 set at a predetermined potential; and ceramic disks 212, 213 each made of an insulating material.

The metal disk 211 has holes 211*a*, spring pieces 211*b*, and a focusing electrode 211*c*, in addition to the inlet aperture 300. The lead pins 131 are connected to the metal disk 211 in a state in which the tip thereof penetrates through the holes 211*a*. The spring pieces 211*b* are brought into contact with the inner wall of the tube cylinder 100 in order to stabilize the position of the whole of the electron multiplier unit 200B relative to the tube cylinder 100, particularly, the vertical position relative to the tube axis AX. The focusing electrode 211*c* functions to alter the trajectories of the photoelectrons, in order to guide the photoelectrons from the cathode 110 to the inlet aperture 300 provided in the first support member 210.

Each of the ceramic disks 212, 213 is also provided with holes 212*a* or 213*a* for letting the lead pins 131 pass, in addition to the inlet aperture 300, and the ceramic disk 213 is further provided with engaging holes 213*b* for keeping the upper fixing pieces DY1*a*, DY2*a*, and 500*a* placed between the first and second support members 210, 220, between the ceramic disks 212, 213.

The second support member 220 is a ceramic disk made of an insulating material, and is provided with holes 220*a* for letting the lead pins 131 pass, and engaging holes 220*b* for accepting the lower fixing pieces DY1, DY2*b*, and 500*b* of the respective members placed between the first and second support members 210, 220. These lower fixing pieces DY1, DY2*b*, and 500*b* are electrically connected to the lead pins 131 each extending from the stem 130, whereby each of the members DY1, DY2, and 500 located between the first and second support members 210, 220 is set at a predetermined potential.

Some of the lead pins 131 extending from the stem 130 are electrically connected to the metal disk 211 via the holes 211*a* of the metal disk 211 in a state in which each pin passes through the hole 220*a* of the second support member 220, the ceramic pipe 230*a*-230*c*, and the holes 212*a*, 213*a* of the ceramic disks 212, 213.

Figure 13A:
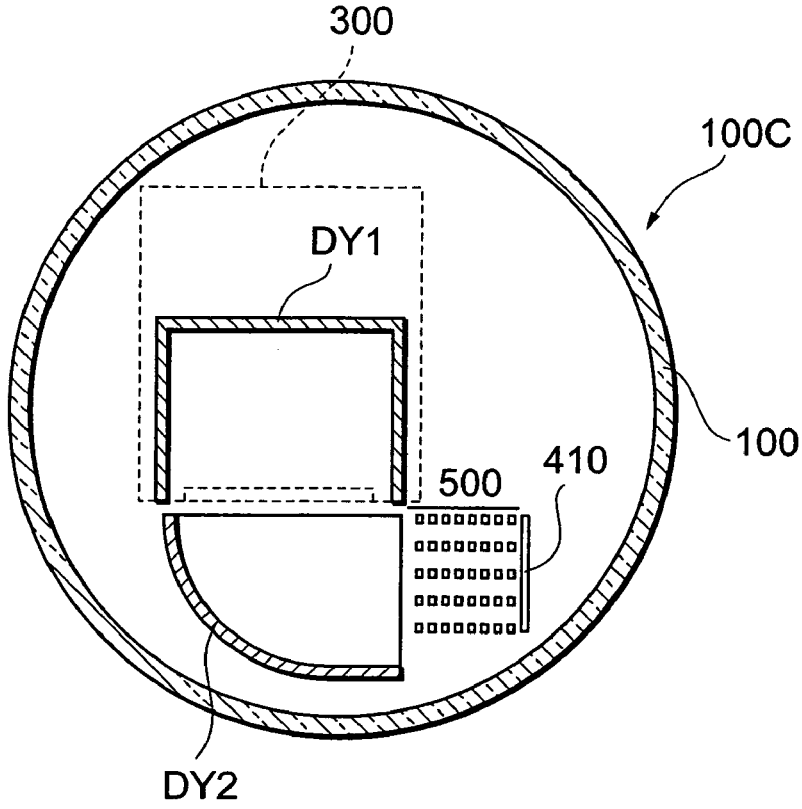
FIG. 13A and FIG. 13B are sectional views (corresponding to the cross section along line I-I in FIG. 1A) showing structures of third and fourth embodiments of the photomultiplier according to the present invention.
Figure 13B:
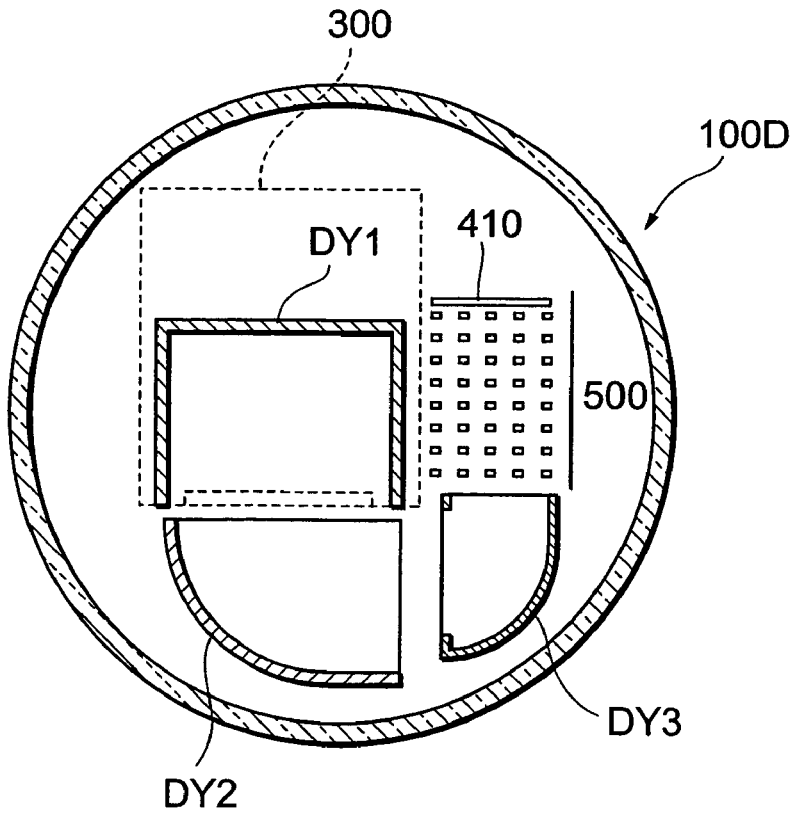

FIGS. 13A and 13B are sectional views showing structures of the third and fourth embodiments of the photomultiplier according to the present invention (corresponding to the cross section along line I-I in FIG. 1A).

Namely, the aforementioned electron multiplier unit 200B (the electron multiplier unit of the second embodiment) is applied to the photomultiplier 100C of the third embodiment, as shown in FIG. 13A, and the electron multiplier unit 200B has a structure in which the dynode unit 500 including the anode plate 410, together with the first dynode DY1 and second dynode DY2, is located in the space between the first and second support members 210, 220.

The photomultiplier 100D of the fourth embodiment has a structure in which the dynode unit 500 including the anode plate 410, together with the first dynode DY1, second dynode DY2, and third dynode DY3, is located in the space between the first and second support members 210, 220, as shown in FIG. 13B, as an electron multiplier unit (an electron multiplier unit of the third embodiment). Since this fourth embodiment involves the cascade multiplication of secondary electrons up to the dynode unit 500 in steps one step more than the second embodiment, it can achieve a larger gain.

Figure 14A:
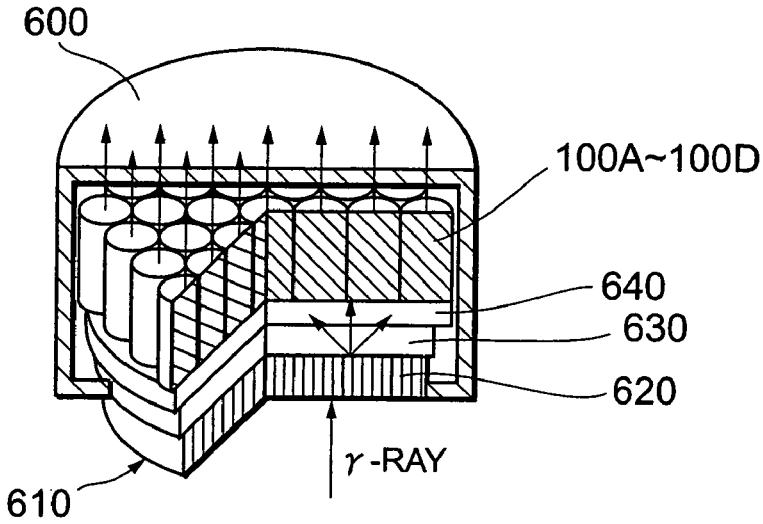
FIGS. 14A to 14C are illustrations for explaining examples of use of the photomultiplier according to the present invention.
Figure 14B:
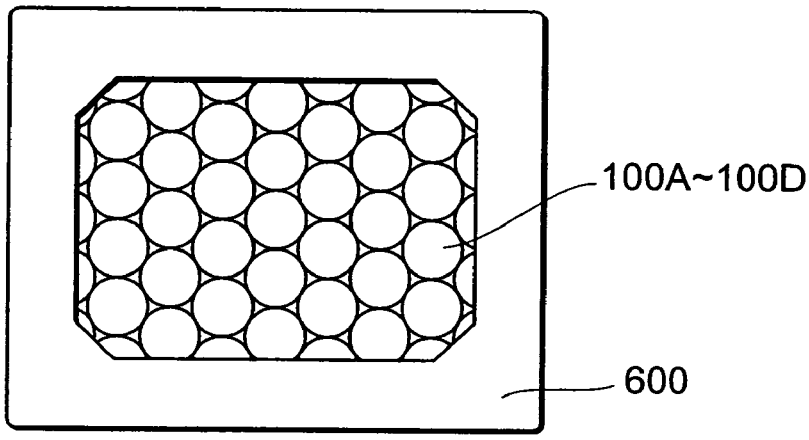
Figure 14C:
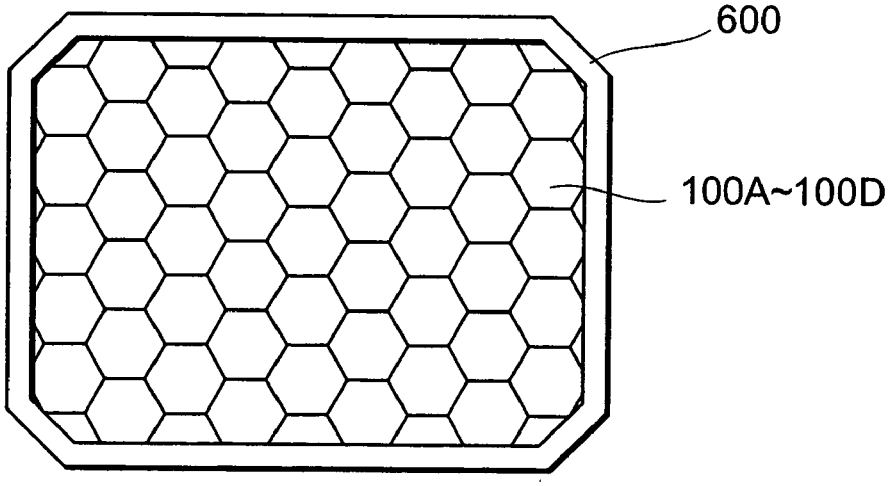

FIGS. 14A to 14C are illustrations for explaining examples of use of the photomultipliers according to the present invention.

Normally, where the photomultipliers are applied to detection of X-rays or radiated rays, the photomultipliers are entirely covered except for a detection window by a heavy metal shield, e.g., Pb. For example, a γ-camera device used as a medical inspection system is provided with at least a pair of upper and lower camera heads, and each camera head is entirely covered except for a detection window for exposing face plates of photomultipliers 100A to 100D two-dimensionally arranged, by a Pb shield 600, as shown in FIG. 14A. Furthermore, a collimator 620, a scintillator 630, and a lightguide 640 are laid in the window 610 of this Pb shield 600. The γ-rays arriving at the detection window 610 are collimated by the collimator 620. The γ-rays thus collimated are directly converted into light of a predetermined wavelength by the scintillator 630, and the light from this scintillator 630 is guided through the lightguide 640 onto the face plates of the respective photomultipliers 100A-100D two-dimensionally arrayed in the Pb shield 600. FIG. 14B shows an arrayed state of the photomultipliers when viewed through the detection window 610 of the Pb shield 600. In the case of the camera head in this structure, the number of photomultipliers used also increased in order to improve the detection resolution by the conventional technologies, and, inevitably, the increase of weight of the detector part including the heavy metal shield would pose an impediment to reduction of weight and size of apparatus. In contrast to it, the photomultipliers 100A-100D according to the present invention have the structure in which the tube length is much shorter than in the conventional photomultipliers, and thus enable reduction of the total weight of the Pb shield, without degradation of resolution (i.e., without decrease in the number of photomultipliers used). On the other hand, by applying the photomultipliers 100A-100D, it also becomes feasible to improve the resolution (or to increase the number of photomultipliers used) without increase in the total weight of the Pb shield.

The face plates of the photomultipliers 100A-100D according to each of the aforementioned embodiments all are circular, but the face plates can be, for example, hexagonal as shown in FIG. 14C, which can drastically increase the effective area relative to the detection window of the Pb shield 600. The configurations shown in FIGS. 14B and 14C employ the photomultipliers whose face plates are all of the same shape, but it is also possible to adopt a configuration in which plural types of photomultipliers of different face plate shapes are combined, or a configuration in which plural types of photomultipliers of different face plate areas are combined. The face plate shape may be triangular, rectangular, pentagonal, or the like, instead of being circular or hexagonal.

It is apparent that the present invention can be modified in various ways in view of the above description of the present invention. Such modifications are not to be regarded as departure from the spirit and scope of the present invention, but all improvements as would be obvious to those skilled in the art are intended for inclusion within the scope of the claims which follow.

What is claimed is:

1. An electron multiplier unit comprising:

a first support member having an inlet aperture for letting primary electrons in, said first support member being comprised of an insulating material;

a second support member located so as to face said first support member, said second support member being comprised of an insulating material;

a first dynode held by said first and second support members while being in direct contact with said first and second support members, said first dynode and having a reflection type secondary electron emission surface arranged to emit secondary electrons in response to incidence of the primary electrons having passed through said inlet aperture, into a space between said first and second support members;

a second dynode held by said first and second support members while being in direct contact with said first and second support members, said second dynode having a reflection type secondary electron emission surface located so as to face said first dynode and arranged to emit new secondary electrons to a side where said first dynode is located, in response to the secondary electrons coming from said first dynode; and an anode for extracting secondary electrons resulting from successive multiplication in the space between said first and second support members, as a signal, said anode being held by said first and second support members while being in direct contact with said first and second support members, at a position where the secondary electrons emitted from said first dynode do not directly arrive.

2. An electron multiplier unit according to claim 1, wherein an electron travel distance from said first dynode to said anode is kept not less than 2 times a distance between said first support member and said second support member.

3. An electron multiplier unit according to claim 2, wherein the electron travel distance from said first dynode to said anode is kept not less than 4 times the distance between said first support member and said second support member.

4. An electron multiplier unit according to claim 1, further comprising:

a focusing electrode comprised of a metal plate of trapezoidal shape cut in a tapered form at both ends, wherein said focusing electrode is fixed to said first support member so that a lower base thereof extends along an outer periphery of said first support member.

5. An electron multiplier unit according to claim 1, wherein said inlet aperture is arranged in a state in which a center thereof is spaced a predetermined distance apart from a center of said first support member.

6. An electron multiplier unit according to claim 1, further comprising:

a dynode unit arranged on an electron travel path from said second dynode toward said anode and comprised of multiple stages of grid type dynodes, wherein said dynode unit is held by said first and second support members.

7. An electron multiplier unit according to claim 6, further comprising:

one or more box type dynodes arranged on an electron travel path from said second dynode toward said dynode unit, wherein said box type dynodes are held by said first and second support members.

8. An electron multiplier unit according to claim 1, further comprising:

a dynode unit arranged on an electron travel path from said second dynode toward said anode and comprised of multiple stages of mesh type dynodes, wherein said dynode unit is held by said first and second support members.

9. An electron multiplier unit according to claim 8, further comprising:

one or more box type dynodes arranged on an electron travel path from said second dynode toward said dynode unit, wherein said box type dynodes are held by said first and second support members.

10. An electron multiplier unit according to claim 1, further comprising:

a control electrode one end of which is fixed to an edge part of said inlet aperture and the other end of which is arranged to be located in a secondary-electron travel space from said first dynode toward the second dynode.

11. A photomultiplier comprising:

a sealed envelope;

a cathode placed in said sealed envelope and arranged on an inner wall portion of said sealed envelope facing a bottom of said sealed envelope to emit photoelectrons into said sealed envelope in response to incidence of light of a predetermined wavelength; and an electron multiplier unit according to claim 1 housed in said sealed envelope while being separated from said bottom of said sealed envelope by a predetermined distance, said electron multiplier unit being arranged such that at least said second support member thereof is positioned between said first support member thereof having the inlet aperture and said bottom of said sealed envelope to successively emit secondary electrons in multiple stages in response to incidence of the photoelectrons emitted as primary electrons from said cathode, thereby enabling cascade multiplication of electrons.

12. A photomultiplier according to claim 11, wherein in said electron multiplier unit an electron travel distance from said first dynode to said anode is kept not less than 2 times a distance between said first support member and said second support member.

13. A photomultiplier according to claim 12, wherein in said electron multiplier unit the electron travel distance from said first dynode to said anode is kept not less than 4 times the distance between said first support member and said second support member.

14. A photomultiplier according to claim 11, wherein in said electron multiplier unit an electron travel distance from said first dynode to said anode is kept not less than 1.5 times an electron travel distance from said cathode to said first dynode.

15. A photomultiplier according to claim 11, wherein an electron travel distance from said cathode to said anode is kept not less than 2 times an electron travel distance from said cathode to said first dynode.

16. A photomultiplier according to claim 11, wherein said electron multiplier unit further comprises a focusing electrode comprised of a metal plate of trapezoidal shape cut in a tapered form at both ends, said focusing electrode being fixed to said first support member so that a lower base thereof extends along an outer periphery of said first support member.

17. A photomultiplier according to claim 11, wherein said inlet aperture in said electron multiplier unit is arranged in a state in which a center thereof is spaced a predetermined distance apart from a center of said first support member.

18. A photomultiplier according to claim 11, wherein said electron multiplier unit further comprises a dynode unit arranged on an electron travel path from said second dynode toward said anode and comprised of multiple stages of grid type dynodes, said dynode unit being held by said first and second support members.

19. A photomultiplier according to claim 18, wherein said electron multiplier unit further comprises one or more box type dynodes arranged on an electron travel path from said second dynode toward said dynode unit, said box type dynodes being held by said first and second support members.

20. A photomultiplier according to claim 11, wherein said electron multiplier unit further comprises a dynode unit arranged on an electron travel path from said second dynode toward said anode and comprised of multiple stages of mesh type dynodes, said dynode unit being held by said first and second support members.

21. A photomultiplier according to claim 20, wherein said electron multiplier unit further comprises one or more box type dynodes arranged on an electron travel path from said second dynode toward said dynode unit, said box type dynodes being held by said first and second support members.

22. A photomultiplier according to claim 11, wherein said electron multiplier unit further comprises a control electrode one end of which is fixed to an edge part of said inlet aperture and the other end of which is arranged to be located in a secondary-electron travel space from said first dynode toward said second dynode.

* * * * *